US012613079B1

(12) United States Patent
Li

(10) Patent No.: US 12,613,079 B1
(45) Date of Patent: Apr. 28, 2026

(54) BORESIGHT DEVICE, FIREARM CALIBRATION SYSTEM, AND METHOD

(71) Applicant: Beijing Huihaozi Technology Co., Ltd., Beijing (CN)

(72) Inventor: Huicai Li, Beijing (CN)

(73) Assignee: Beijing Huihaozi Technology Co., Ltd., Beijing (CN)

( * ) Notice: Subject to any disclaimer, the term of this patent is extended or adjusted under 35 U.S.C. 154(b) by 0 days.

(21) Appl. No.: 19/277,707

(22) Filed: Jul. 23, 2025

(51) Int. Cl.
*F41A 33/02* (2006.01)
*F41G 1/54* (2006.01)

(52) U.S. Cl.
CPC ..... *F41G 1/54* (2013.01)

(58) Field of Classification Search
CPC ..... F41G 1/54
See application file for complete search history.

(56) References Cited

U.S. PATENT DOCUMENTS 3,938,262 A * 2/1976 Dye ..... F41G 3/2655 434/21
4,678,437 A * 7/1987 Scott ..... F41A 33/02 434/21
4,879,814 A * 11/1989 Wallace ..... F41G 3/323 89/200
5,365,669 A * 11/1994 Rustick ..... F41A 33/02 42/134
5,685,106 A * 11/1997 Shoham ..... F41G 1/35 42/116
6,216,381 B1 * 4/2001 Strand ..... F42B 8/02 42/113
6,389,730 B1 * 5/2002 Millard ..... F41A 33/02 42/116
6,499,247 B1 * 12/2002 Peterson ..... F41G 1/54 42/116
6,606,797 B1 * 8/2003 Gandy ..... F41A 33/02 33/227
6,631,580 B2 * 10/2003 Iafrate ..... F41A 33/02 42/134
6,742,299 B2 * 6/2004 Strand ..... F41A 33/02 42/134
7,947,937 B1 * 5/2011 Langner ..... F42B 12/42 102/501

(Continued)

OTHER PUBLICATIONS

Huicai Li, authorized a company "Beijing Hulhaozi Technology Co., Ltd." to disclose and sell the entitled application since Aug. 7, 2024 on following links: https://www.amazon.com/CVLIFE-Sight-5-56mm-Magnetic-Batteries/dp/B0DCDDVF5F/ref=sr_1_17?crid=EQ07BVI99O7K&dlb=eyJ2ljoiMSJ9.P1XtxfP8nYQ3SPe6iRjmEOGPqh2Gpcu9tgDjQtTPzYJuv6Pz0rp4mrT5BSfRmtY57S2YImALZo_0H60uAecctc6Gmj0hdJNPfic6kvQDFEFVMW-.IjGVYpGWzxYGW7vPar-UgMFeCx1jVg8_HpEmXtDQPhQzevZDK5j40-B_AQiiF2W8orFEFHGeWxV7wUi_3GdCnNzm--MXCHcqbJyUTF-pqwQs6dm_GpwL5n2zkgAzal2ys6880Ay_WjkdnADrC5tQN-9aq392_gN5XTm_mC3_FLrNfD_PEycugq1l2SFe4uO2Xuovnbii1LkmkZYaQev-mJrWphNPjkID1RBkuo1AHLHx5qx26RcnXBxL20sol.d7jeTjmWFa2lw4E-C2KSHfOc6b47CFYN9ZhVMjwik6g&dib_tag=se&keywords=cvlife%2Bbore%2Bsighter&qid=1736473392&s=sporting-goods&sprefix=cvlife%2Bbore%2Bsighters%2Csporting%2C363&sr=1-17&th=1.

*Primary Examiner* — Derrick R Morgan
(74) *Attorney, Agent, or Firm* — ScienBiziP, P.C.

(57) ABSTRACT

A boresight device for calibrating a firearm and insertable into a chamber of the firearm. The boresight device includes a housing, a light-emitting assembly, and a magnet. A boresight device for calibrating a firearm is insertable into a chamber of the firearm. The housing is configured to be placed in the chamber of the firearm, the housing defines an emitting surface at a first end. The light-emitting assembly is received in the housing and is configured to emit a light beam out of the firearm when the housing is placed in the firearm. The magnet is attached to the housing. The magnet (Continued)

is positioned to magnetically engageable with a portion of the firearm, and the magnet is movable relative to the chamber.

18 Claims, 5 Drawing Sheets

(56) References Cited

U.S. PATENT DOCUMENTS 8,186,094 B2 * 5/2012 AlKandari ..... F41G 1/54 42/121
9,163,904 B2 * 10/2015 Ohr ..... F41A 17/44
11,585,636 B2 * 2/2023 Oliver ..... G09B 9/003
2006/0265929 A1 * 11/2006 Haney ..... F41G 3/2655 434/21
2007/0144393 A1 * 6/2007 Kusz ..... F42B 5/10 102/374
2007/0169392 A1 * 7/2007 Davis ..... F41G 3/323 42/120
2011/0207088 A1 * 8/2011 Uhr ..... F41A 35/00 434/21
2011/0219658 A1 * 9/2011 AlKandari ..... F41G 1/54 42/116
2011/0281242 A1 * 11/2011 Charles ..... F41A 33/02 434/16
2012/0042560 A1 * 2/2012 Jackson ..... F41A 33/02 42/116
2013/0122471 A1 * 5/2013 Yach ..... F41J 5/02 434/22
2016/0216067 A1 * 7/2016 Jackson ..... F41G 1/35
2020/0064104 A1 * 2/2020 Uhr ..... F41A 17/44
2020/0141685 A1 * 5/2020 Liu ..... F41G 1/54
2023/0106290 A1 * 4/2023 Uhr ..... F41A 35/00 434/21
2023/0194209 A1 * 6/2023 Seigler ..... F41A 33/02 434/21
2023/0213313 A1 * 7/2023 Uhr ..... F41A 33/02 434/22
2023/0341216 A1 * 10/2023 Monti ..... F41A 33/02

* cited by examiner

BORESIGHT DEVICE, FIREARM CALIBRATION SYSTEM, AND METHOD

TECHNICAL FIELD

The present disclosure relates to the technical field of firearm calibration technology, and more particularly to a boresight device, a firearm calibration system including the boresight device, and a method.

BACKGROUND ART

In fields such as military trainings, police law enforcements, and shooting competitions, the accuracy of a firearm sight calibration directly impacts the operational effectiveness and the competitive performance. A traditional method of live-fire calibration relies on multiple test shots, observation of impact points, and sight adjustments. The above described method is cumbersome, susceptible to environmental factors, and difficult to achieve a precise calibration. To solve this issue, an insertable boresight device that emits laser light has emerged. By inserting the insertable boresight device into a chamber of a firearm, a collimated light beam simulates a bullet trajectory, thereby enabling rapid sight adjustment.

However, it is difficult to remove the insertable boresight device from the chamber of the firearm in practical use. To ensure the calibration accuracy, the boresight device must closely fit with an inner size of the chamber, such as through an interference fit or precision tolerance design. This results in an excessive friction being generated between the boresight device and an inner wall of the chamber in such a narrow space in the chamber, which makes removal difficult. Therefore, providing a boresight device that can be easily disassembled from the chamber is a key technical challenge that need to be urgently addressed.

BRIEF DESCRIPTION OF DRAWINGS

FIG. 4 illustrates a method to insert the boresight device into a chamber of a firearm during calibration according to an embodiment of the present disclosure.

DETAILED DESCRIPTION

Figure 1:
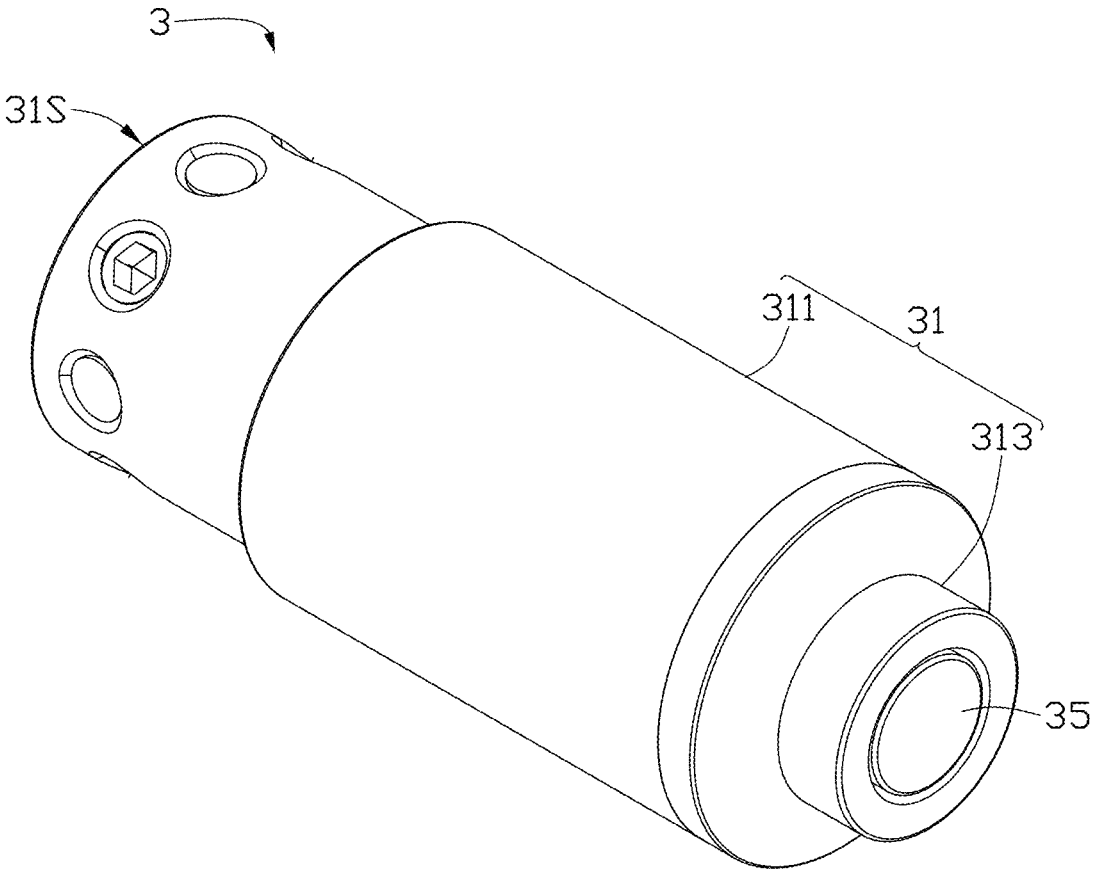
FIG. 1 is a perspective view of a boresight device according to an exemplary embodiment of the present disclosure.

Referring to FIGS. 1-5, the present disclosure relates to a boresight device 3 for a chamber 122 of a firearm 1, a firearm calibration system 100 using the boresight device 3, and a method for calibrating the firearm 1 by using the firearm calibration system 100. The firearm 1 includes a firearm body 110 and a barrel 120. The chamber 122 is defined in the barrel 120, and is aligned coaxial with a centerline of the barrel 120 to load a cartridge 2. The boresight device 3 is configured to be inserted into the chamber 122, and emits a collimated light beam L1 along the centerline of the barrel 120, the light beam L1 is configured to simulate the cartridge's ballistic trajectory.

The cartridge 2 includes a projectile 201 (e.g., a bullet) and a casing 202 holding the projectile 201. The barrel 120 has a channel for guiding the projectile 201 during firing. The channel penetrates the barrel 120 along the centerline of the barrel 120. A muzzle (not shown) is an opening, serving as an exit for the fired projectile 201, defined at an end of the barrel 120. The chamber 122 is defined at the other end of the barrel 120. An inner diameter of the chamber 122 is larger than an inner diameter of other portion of the barrel 120. This configuration allows the cartridge 2 to maintain a stable posture in the chamber 122 before firing.

When the cartridge 2 to be fired is loaded into the chamber 122 of the firearm 1, the projectile 201 is aligned with the muzzle of the barrel 120. During firing, the projectile 201 accelerates through the channel toward the muzzle and is ejected externally, while the casing 202 remains in the chamber 122 temporarily and will be ejected through an ejection port 110*a* before next firing.

A sighting device 170 (e.g., a mechanical sight or an optical sight) is mounted on an outer side of the firearm body 110 so as to allow a shooter to aim at a target (not shown). During a calibration, the shooter observes, through the sighting device 170, a light spot on the target formed by the light beam L1 emitted by the boresight device 3. The sighting device 170 includes an aiming point (e.g., a reticle with a crosshair, not shown) as its aiming reference. The shooter adjusts the sighting device 170 to align the aiming point with the light spot on the target at a predetermined distance, and thus the calibration can be completed. This alignment ensures an aiming direction of the sighting device 170 coincides with a simulated ballistic trajectory of the cartridge 2, thus completing the calibration of the sighting device 170.

Additionally, an offset may exist between a centerline of the chamber 122 and the centerline of the barrel 120. In such cases, before the calibration, the shooter can use the light beam L1 to confirm whether the centerline of the chamber 122 and the barrel 120 satisfy a coaxiality requirement. When the offset is confirmed between the centerline of the chamber 122 and the centerline of the barrel 120, corrections to the firearm components may be performed via a mechanical process (e.g., grinding, cutting), stress relief, component replacement, or adjustment of connection positions among various components, with other existing methods also being applicable.

The following embodiment provides the boresight device 3 of an exemplary embodiment of the present disclosure, then provides the firearm calibration system 100 incorporating the boresight device 3, and further provides the method for calibrating the firearm 1 by using the firearm calibration system 100.

Figure 2:
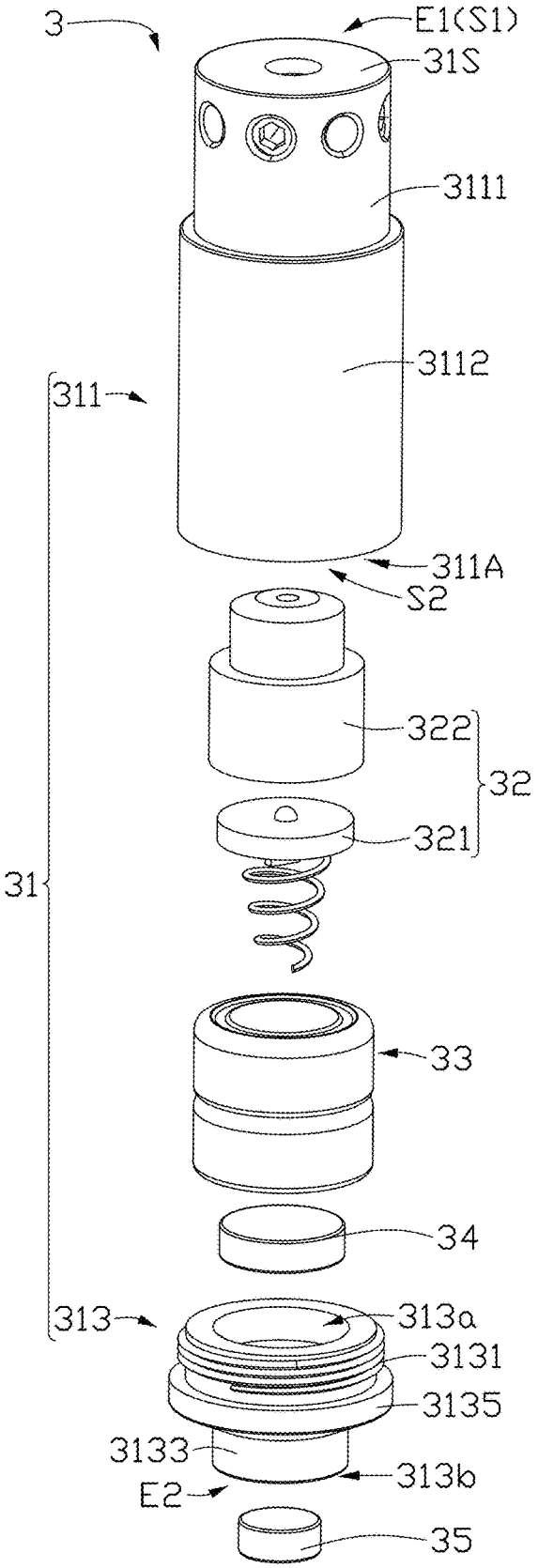
FIG. 2 is an exploded, perspective view of the boresight device shown in FIG. 1.
Figure 3:
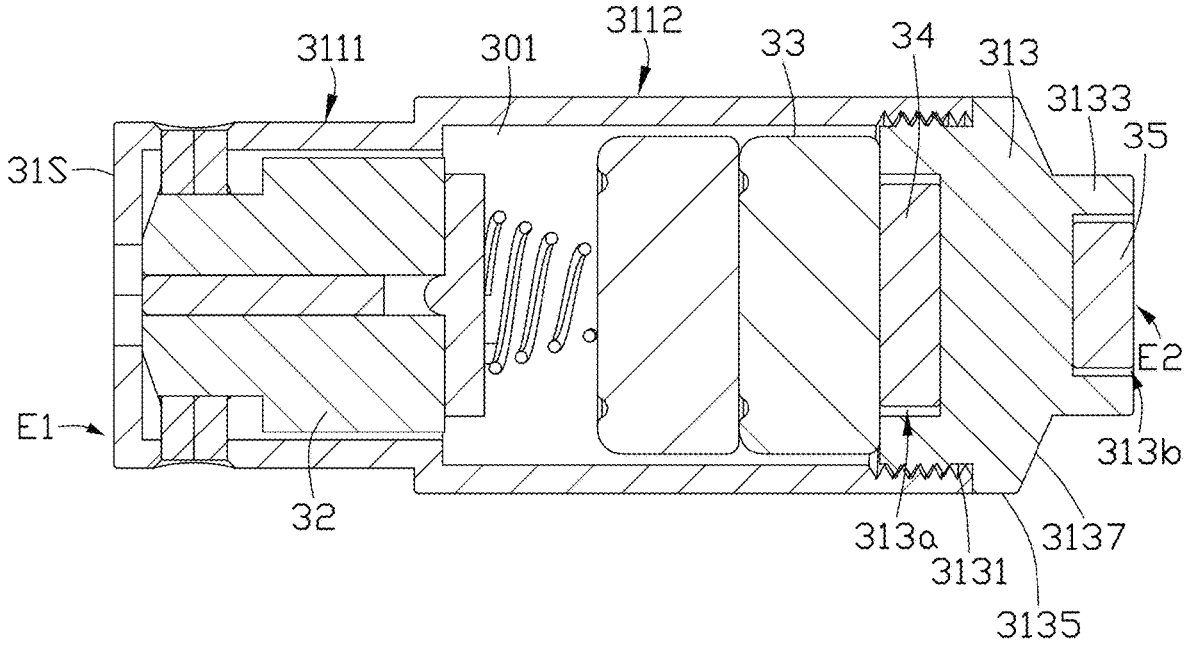
FIG. 3 is a cross-sectional view of the boresight device shown in FIG. 1.

As shown in FIGS. 1 to 3, the boresight device 3 includes a housing 31 and a light-emitting assembly 32 received in an internal cavity 301 of the housing 31. The light-emitting assembly 32 is configured to emit the light beam L1 to an exterior of the housing 31. The housing 31 (as well as the boresight device 3) includes a first end E1 and a second end E2 opposite to the first end E1. An emitting surface 31S defined at the first end E1 is configured to output the light beam L1. Thus, the boresight device 3 is configured to direct the light beam L1 toward the muzzle via the emitting surface 31S and further to point to the target outside the firearm 1 when inserted in the chamber 122.

A first magnet 35 is provided on the second end E2 away from the emitting surface 31S (i.e., a side away from the muzzle). The first magnet 35 exhibits magnetism and imparts magnetism to the second end E2 of the boresight device 3. Even when the boresight device 3 is tightly fitted or affix in the chamber 122 of the barrel 120, a smooth extraction from the barrel 120 may be achieved by magnetically engaging with a magnetically attractable component such as an additional tool or a portion of the firearm 1 (e.g., a firing end 131 that is movable relative to the chamber 122). When the magnetically attractable part moves away from the chamber 122, the boresight device 3 moves together with the magnetically attractable part because of a magnetic interaction between the first magnet 35 and t the magnetically attractable part thereby moving the boresight device 3 out of the chamber 122, simplifying an extraction of the boresight device 3.

To more closely match a shooting direction of the cartridge 2, the boresight device 3 is preferably tightly fitted in the chamber 122, with its emitting surface 31S facing the muzzle of the firearm 1. The dimensions of the housing 31 of the boresight device 3 may be directly designed according to an inner diameter and axial length of the chamber 122, or may be designed to mimic the shape and dimensions of the casing 202 of the cartridge 2. Thus, the boresight device 3 may be tightly fitted or temporarily affix in the chamber 122 of the barrel 120.

As shown in FIGS. 1 and 3, the housing 31 is generally cylindrical. At least a part of an outer wall of the housing 31 contacts a surrounding wall of the chamber 122, stabilizing the posture of the boresight device 3 during the calibration and ensuring the coaxiality of the light beam L1 with the centerline of the barrel 120, thereby enabling the high-precision calibration of the sighting device 170 of the firearm 1. when the boresight device 3 is configured to be inserted in the chamber 121, the first magnet 35 is positioned to magnetically engageable with the portion of the firearm 1 (e.g., the firing end 131), and the portion of the firearm 1 align with the muzzle and the chamber 122, and the portion of the firearm 1 is located away from the muzzle. When the portion of the firearm 1 moves away from the chamber 122, and the portion of the firearm 1 is attached by the first magnet 3 thereby pulling the boresight device 3 away from the muzzle.

The boresight device 3 further includes components such as the light-emitting assembly 32 and a power source 33 received in the housing 31. The power source 33 supplies powers to the light-emitting assembly 32, enabling it to emit the light beam L1 that forms the light spot on the target when irradiated towards the target. Since the light beam L1 propagates linearly in the air, the light beam L1 is also configured to simulate the centerline of the chamber 122, which is aligned with the bullet trajectory.

The light-emitting assembly 32 may adopt a conventional configuration, such as including a light source 321, an optical system (not shown) having a resonator cavity, a control structure (not shown) for controlling a light emission of the light source 321, and the like.

As the light source 321, for example, a laser light source with good directivity, excellent monochromaticity, and high brightness may be used. Common semiconductor laser light sources such as GaAs/AlGaAs, or solid-state laser light sources that use semiconductor light-emitting diodes as excitation sources to excite solid working substances may be used, but it is not limited thereto. Other existing configurations may be used as long as a single linear light beam L1 can be emitted from the housing 31. The optical system may be fixed in a fixing portion 322. The cross-section of the fixing portion 322 is approximately stepped, and its central hole is configured to receive the optical system. One end face of the fixing portion 322 is formed into a conical surface and abuts against the emitting surface 31S, while the other end abuts against the light source 321. A part of the outer periphery of the fixing portion 322 is away from an inner wall of the housing 31, while another part abuts against the inner wall of the housing 31. Through fasteners such as adjusting screws, the fixing portion 322 can be fixed relative to the housing 31, and at the same time, the fixing portion 322 can be adjusted to be coaxial with the housing 31, so that the emitted linear light beam L1 is perpendicular to the emitting surface 31S.

As shown in FIGS. 2 and 3, the housing 31 includes a first part 311 and a second part 313 detachably attached to the first part 311. the first part 311 is hollow and has an open end. The light-emitting assembly 32 and the power source 33 are inserted in the first part 311 from the open end, the second part 313 is detachably attached to the open end, thereby facilitating maintenance and replacement of internal components such as the light-emitting assembly 32 and the power source 33.

The first part 311 is formed as a substantially cylindrical shape, and defines a receiving space 311A in the first part 311. The receiving space 311A extends along a centerline of the first part 311. The first part 311 includes two opposite sides, such as a first side S1, and a second side S2 serving as the open end of the first part 311. The second side S2 has an opening where the second part 313 is positioned, and the opening is air communicated with the receiving space 311A. The receiving space 311A is adapted to receive the light-emitting assembly 32 and the power source 33. An end surface of the first side S1 (i.e., the first end E1) of the first part 311 serves as the emitting surface 31S, wherein an aperture is formed on the emitting surface 31S. The light beam L1 emitted by the light-emitting assembly 32 is arranged to pass through the aperture and exit to the exterior of the first part 311. The light-emitting assembly 32 is arranged to be closer to the emitting surface 31S than the power source 33. The first part 311 forms an inner wall which defines the receiving space 311A with a limiting structure and/or a connecting structure for fixing components such as the light-emitting assembly 32 in the receiving space 311A to prevent displacements of the components during use. The opening of the first part 311 is covered and connected by the second part 313. The second part 313 is also removable from the opening, for replacing the components in the receiving space 311A.

The first part 311 includes a first portion 3112 extending along the centerline of the first part 311 with a first diameter. The first part 311 may include a second portion 3111 extending from the first portion 3112 with one end formed as the emitting surface 31S, wherein the second portion 3111 has a second diameter smaller than a diameter of the first portion 3112. However, the present disclosure is not limited thereto, and the light-emitting assembly 32 may be received at a position corresponding to the second portion 3111, and a part thereof may also be received at a position corresponding to the first portion 3112. The second part 313 includes a connection end 3131 and a tail end 3133 opposite to each other. The connection end 3131 is configured to connect the second part 313 to the first part 311. The tail end 3133 extends in a direction away from the first part 311.

The first part 311 and the second part 313 are detachably connected to each other. Especially, threads are formed on an outer wall of one of the first part 311 and the second part 313 and an inner wall of the other one, and extraction and insertion are achieved via a threaded engagement. For example, the connection end 3131 is configured to sleeve onto/into the open end of the first portion 3112, with the thread formed on the outer wall thereof mating with the thread formed on an inner wall of the first portion 3112. Alternatively, the first part 311 and the second part 313 may be coupled via a snap-fit mechanism, wherein a snap protrusion is provided at an edge of the first part 311, and a snap groove complementary to the snap protrusion is formed at a corresponding position of the second part 313. For effective insertion, the snap protrusion is snapped into the snap groove, achieving a secure connection through a deformation of the snap protrusion; for effective extraction, the snap protrusion is pulled to move along the snap groove by applying an external force, thereby separating the first part 311 and the second part 313. The present disclosure is not limited to the above methods and may employ other existing methods. Additionally, the first part 311 and the second part 313 may be fixedly connected to each other, such as by welding, adhesive encapsulation, or integral formation.

The first magnet 35 is attached to the second end E2 of the boresight device 3, which is located away from the emitting surface 31S (i.e., a side located at the tail end 3133). The first magnet 35 is received in the housing 31. The first magnet 35 comprises an end surface opposite the portion of the firearm 1 (e.g., the firing end 131) on a side located away from the light-emitting assembly 32. A first recess 313*b* is formed at the tail end 3133 by recessing toward the connection end 3131. The first recess 313*b* is adapted to receive the first magnet 35, and a part of the end surface is exposed from the first recess 313*b*.

The end surface includes an exposed portion exposed to the portion of the firearm 1 and a covered portion other than the exposed portion and covered by the housing 31. A size of the exposed portion is greater than a size of the covered portion, wherein even if a magnetic interaction force between the firing end 131 and the first magnet 35 is partially reduced by the covered portion, the magnetic interaction force remains sufficient to enable the extraction of the boresight device 3. Alternatively, the covered portion occupies less than one-third of the entire end surface. Optionally, the entire end surface is exposed. The covered portion serves to block blocking the first magnet 35 from loosening or dislodging from the first recess 313*b*. Thus, the first magnet 35 is tightly received in the first recess 313*b* even without additional fixing means.

Alternatively, the exposed portion may be substantially flush with the housing 31. The first magnet 35 is tightly received in the first recess 313*b* by an interference fit, where an outer size of the first magnet 35 is larger than an inner size of the first recess 313*b*. When the first magnet 35 is pressed into the first recess 313*b*, it becomes affix due to the interference. Alternatively, the first magnet 35 may be tightly received in the first recess 313*b* by applying an adhesive layer on an inner wall of the first recess 313*b* to firmly adhere the first magnet 35 in the recess 313*b*. Alternatively, an other magnet may be arranged in the connection end 3131 opposite to the tail end 3133, which may incorporate a material with an opposite magnetic pole, such that the first magnet 35 is attracted by the other magnet and not easily detached from the first recess 313*b*. As an example, the connection end 3131 may also be received with a second magnet 34 as the other magnet having a magnetic pole different with the first magnet 35. The second magnet 34 may be made of the same material as the first magnet 35 and have a magnetic pole opposite to that of the first magnet 35, such that the first magnet 35 and the second magnet 34 are magnetically attracted to each other. The connection end 3131 extends toward the first part 311 side and has a second recess 313*a* formed by indentation toward a side away from the emitting surface 31S. The second recess 313*a* communicates with the receiving space 311A of the first part 311 and is configured to receive the second magnet 34. The second magnet 34 and the first magnet 35 are positioned opposite each other. The second magnet 34 may be tightly received in the second recess 313*a* by an interference fit, another adhesive layer, or the like.

The first magnet 35 may be a permanent magnet, such as a ferrite permanent magnet represented by a formula, $MO{\cdot}Fe_2O_3$(M is one or more metals selected from Ba, Sr, Ca, Mg, Zn and Pb, and MO represents a metal oxide formed by the combination of the metal element M and oxygen). More preferably, the first magnet 35 may be a magnet with a higher magnetic strength (determinable by a remanence) than the ferrite permanent magnet, such as a neodymium-iron-boron (NdFeB) permanent magnet, an aluminum-nickel-cobalt (AlNiCo) permanent magnet, or an iron-chromium-cobalt (FeCrCo) permanent magnet. Specifically, at room temperature (ranging from 20° C. to 25° C.), a remanence of the ferrite permanent magnet is approximately from 0.2 T to 0.45 T, while a remanence of the NdFeB permanent magnet is approximately from 0.8 T to 1.45 T, a remanence of the AlNiCo permanent magnet is approximately from 0.5 T to 1.35 T, and a remanence of the FeCrCo permanent magnet is approximately from 0.6 T to 1.2 T. This makes the NdFeB, AlNiCo, and FeCrCo permanent magnets more preferred than the ferrite permanent magnet due to their higher magnetic strengths. When the covered portion is covered by the housing 31, such magnets with higher magnetic strengths are particularly preferred.

The present disclosure is not limited thereto; instead of placing the first magnet 35 received in the housing, the tail end 3133 may be made of a magnetic material such that magnetically engages with the magnetically attractable part.

Additionally, the magnetic polarity of the second magnet 34 may be independently defined, and not opposite to that of the first magnet 35, such that the polarities may be either identical or opposite. The second magnet 34 may magnetically attract at least one cylindrical cell of the detachable power source 33 with/without attracting the first magnet 35. Consequently, during removal of the power source 33, the second magnet 34 secures at least one cylindrical cell via the magnetic attraction, thereby facilitating cell replacement.

The second part 313 may further include a flange portion 3135 extending radially between the connection end 3131 and the tail end 3133, which has an outer diameter greater than those of the connection end 3131 and the tail end 3133. The outer diameter may equal to or smaller than an outer diameter of the first portion 3112. When an outer wall of the connection end 3131 contacts an inner wall of the first part 311, the flange portion 3135 abuts against an end edge of the open side of the first part 311, thereby enhancing the sealing performance of the housing 31 and preventing water and oxygen from corroding internal components. It is understood that the flange portion 3135 may be omitted.

Additionally, a transition portion 3137 may be provided between the flange portion 3135 and the tail end 3133. An outer peripheral surface of the flange portion 3135 connects with an outer peripheral surface of the transition portion 3137 and the outer peripheral surface of the transition portion 3137 further connects with an outer peripheral surface of the tail end 3133, the transition portion 3137 having an outer diameter that progressively increases from the tail end 3133 toward the flange portion 3135.

As described above, the firearm 1 is calibrated at low cost and high precision, and the boresight device 3 is smoothly extracted from the chamber 122 of the barrel 120 by using the magnetically attractable component, thereby simplifying extraction of the boresight device 3.

Figure 4:
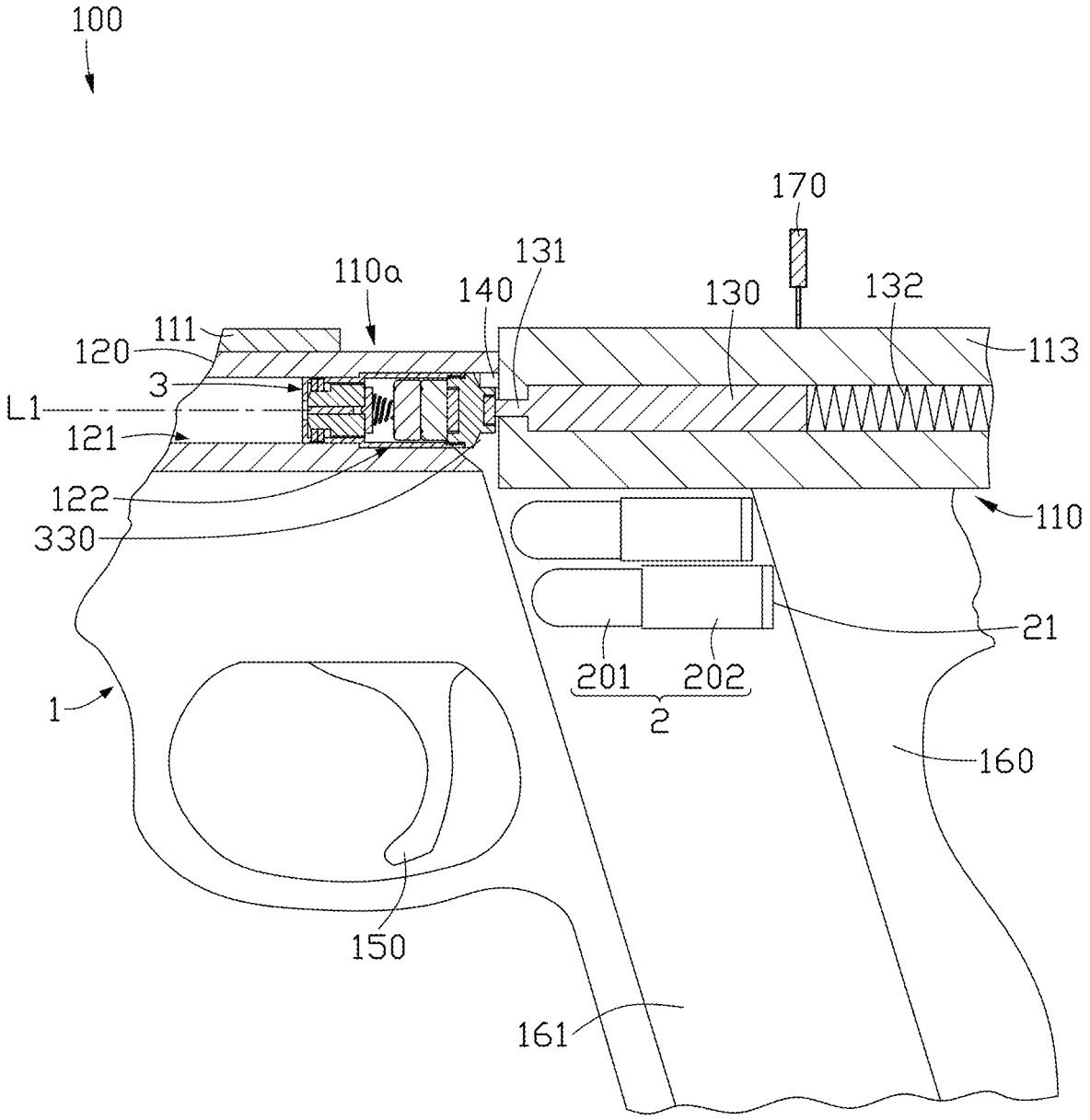
FIG. 4 is a schematic diagram illustrating a first embodiment of a firearm calibration system using the boresight device of FIG. 1.
Figure 5:
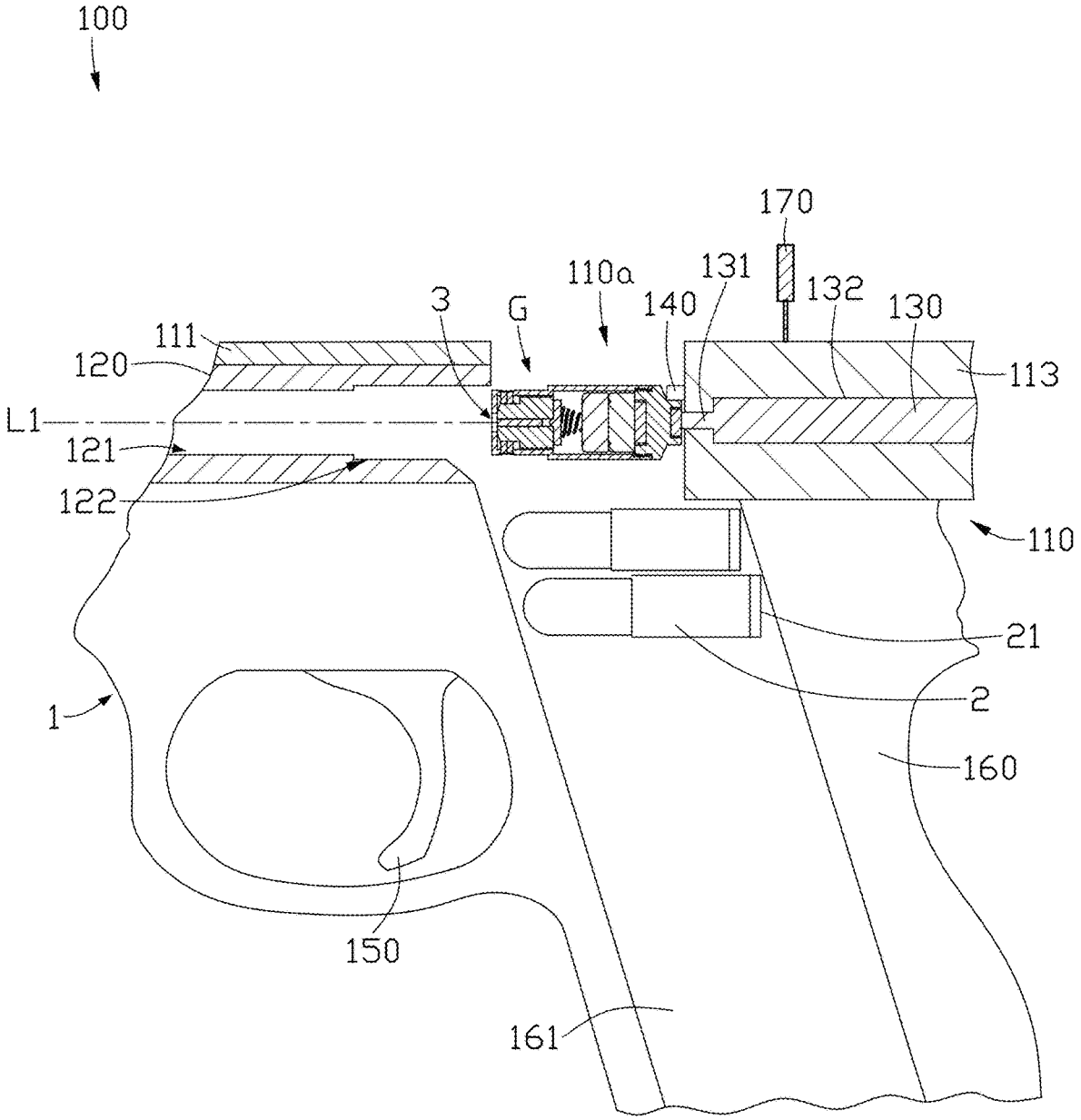
FIG. 5 is a schematic diagram illustrating a second embodiment of the firearm calibration system using the boresight device of FIG. 1, FIG. 5 further illustrates the boresight device in an extracted position after calibration and prior to removal according to an embodiment of the present disclosure.

FIG. 4 is a schematic diagram illustrating a first embodiment of the firearm calibration system 100 using the boresight device 3, and also serves as an illustration for explaining the method for inserting the boresight device 3 into the chamber 122 of the firearm 1 during calibration. FIG. 5 is a schematic diagram illustrating a second embodiment of the firearm calibration system 100 using the boresight device 3, and further showing the boresight device 3 in an extracted position after calibration and prior to removal.

The firearm 1 shown in FIGS. 4 and 5 are exemplified by a semi-automatic pistol (e.g., M1911), but the firearm 1 of the present disclosure is not limited thereto, and is applicable to other existing firearms, and is not limited to automatic or semi-automatic firearms. The basic structure of the firearm 1 includes a main body 110, the barrel 120, a magazine 160, a firing assembly, a trigger assembly, and the sighting device 170.

The main body 110 is configured for being held by the shooter. The main body 110 is movable relative to the barrel 120. The barrel 120, the magazine 160, the firing assembly, the trigger assembly are installed in/on the main body 110. The main body 110 includes a first component 111 at a front side of the main body 110 and a second component 113 at a rear side of the main body 110 aligned with the first component 111. The barrel 120 is received in the first component 111. The firing assembly is disposed opposite to the second component 113. The main body 110 forms a window 110*a* serves as the ejection port, located between the first component 111 and the second component 113.

The firing assembly is configured to fire (ignite) the cartridge 2 and is installed in the second component 113 of the main body 110. In a typical structure of the firearm 1, the firing assembly generally includes a firing pin 130 and a spring 132 for providing elastic potential energy to the firing pin 130. The firing assembly is capable of achieving a firing action by releasing the spring 132 from a compressed state to impart kinetic energy to the firing pin 130, and a reset action by re-compressing the spring 132 to the compressed state to store elastic potential energy. The firing pin 130 includes the firing end 131 that extends distally from the second component 113 toward the barrel 120. The firing end 131 is made of metal and is capable of contacting the boresight device 3 inserted in the chamber 122 during calibrating the firearm 1. When the main body 110 moves relative to the barrel 120, the firing pin 130 moves together with the main body 110, such that the firing end 131 moves relative to the chamber 122.

The trigger assembly includes a trigger 150. When the trigger assembly is actuated (e.g., the trigger 150 is pulled by the shooter), a firing action is executed in conjunction with the firing assembly. The magazine 160 includes a magazine space 161 for storing a plurality of cartridges 2. During shooting, the cartridges 2 are sequentially loaded into the chamber 122 to be fired.

The main body 110 is movable relative to the chamber 122 along the centerline of the barrel 120, and switchable between a first location abutting against the second component 113 and a second location being spaced apart from the second component 113 by a gap G, and this movement is achieved, for example, by firing and resetting the firing assembly.

When the second component 113 is spaced away from the barrel 120 by the gap G (e.g., when the firing assembly is reset), the window 110*a* is air communicated with the chamber 122 of the barrel 120, and the window 110*a* provides a passage for the boresight device 3 to enter and exit the chamber 122. At the same time, the gap G between the second component 113 and the barrel 120 ensures space for the next firing cartridge 2 to enter.

When the second component 113 abuts against the barrel 120 (e.g., when the firing assembly is fired), the window 110*a* is closed by the barrel 120, and the tail end 3133 of the boresight device 3 or the first magnet 35 provided thereon is magnetically attracted to the firing end 131.

To extract the boresight device 3, it is only necessary to repeat the state where the second component 113 is spaced away from the barrel 120 by the gap G. At this time, the first magnet 35 of the boresight device 3, for example, remains magnetically attracted to the firing end 131, and the boresight device 3 moves toward the firing end 131 based on the magnetic attraction, and is carried out of the barrel 120. Additionally, it is preferable that the exposed portion of the first magnet 35 is covered by a buffering layer (not shown) which is elastic, such as rubber or silicone. The buffering layer is configured to protect the first magnet 35 impacting on the portion of the firearm 1. Thus protecting the boresight device 3 and the firing end 131 from being damaged.

This method, leveraging the magnetic attraction during the relative movement between the barrel 120 and the firearm body 110, enables a convenient extraction of the boresight device 3 without the need for the additional tool or complex operations. Thereby, risks are avoided, including damage to the boresight device 3 from forced extraction, scratches and wear on the inner wall (which impairs the firearm's airtightness and service life) of the chamber 122, and even potential safety hazards. Additionally, in scenarios requiring emergency tasks or rapid firearm replacement, the ability to quickly extract the boresight device 3 enhances the firearm's operational efficiency.

The firearm 1 further includes an ejection hook 140 for hooking and pulling the casing 202 of the cartridge 2 out of the chamber 122 after firing. The ejection hook 140 is installed at the second component 113, is located at a lateral side of the tail end 3133, and does not contact the boresight device 3. Such a design ensures that the boresight device 3 does not interfere with the ejection hook 140 during insertion and use, preventing the ejection hook 140 from damaging the boresight device 3 during calibration and extraction of the boresight device 3, thereby ensuring that calibration and normal shooting of the firearm 1 do not affect each other.

Since the cartridge 2 follows a parabolic trajectory during flight due to gravity, air resistance, etc., it is necessary to calibrate the sighting device 170 of the firearm 1 to ensure shooting accuracy. The aiming point of the sighting device 170 is adjustable such that the trajectory of the cartridge 2 coincides with the aiming point (e.g., the crosshair) of the sighting device 170 at a specific distance. The light beam L1 of the present disclosure simulates the trajectory, and by adjusting the positional relationship (e.g., alignment between the light spot projected by the light beam L1 onto a shooting target (e.g., a target) and the aiming point of the sighting device 170, the sighting device 170 is calibrated (so-called "zeroing"). Thereby, calibration of the sighting device 170 is simplified, and the time and costs associated with live-fire calibrations are reduced.

The method for calibrating the firearm 1 by using the firearm calibration system 100 is describe as below.

First, preparing the firearm calibration system 100.

Next, the shooter operates the firearm 1 to move the main body 110 relative to the barrel 120 in a direction where the firing end 131 moves away from the chamber 122, creating the gap G between the second component 113 and the barrel 120. As shown in FIG. 5, this operation opens the window 110*a*, which sequentially communicates with the gap G and the chamber 122 of the barrel 120.

Next, as shown in FIG. 5, the shooter places the boresight device 3 in the gap G between the barrel 120 and the second component 113 through the window 110*a*, then uses an external force (e.g., a finger) to push the boresight device 3 along the chamber 122 until it is inserted in the chamber 122.

Next, the shooter operates the firearm 1 to move the main body 110 relative to the barrel 120 in a direction where the firing end 131 moves toward the chamber 122. As a result, the gap G gradually narrows and eventually closes until the barrel 120 abuts against the second component 113, as shown in FIG. 4, causing the firing end 131 to contact or magnetically attract without contact the second part 313 of the boresight device 3. This operation closes the window 110*a*.

The shooter then observes whether the light spot emitted by the boresight device 3 (previously activated in a previous process) on the target at the predetermined distance is aligned with the aiming point in the sighting device 170. If a misalignment is confirmed, the shooter adjusts the sighting device 170 by tuning its horizontal/vertical knobs until the aiming point is aligned with the light spot, thereby completing the calibration.

Finally, the shooter operates the firearm 1 again to move the main body 110 relative to the barrel 120 in the direction where the firing end. 131 moves away from the chamber 122. During this process, due to the magnetic interaction between the firing end 131 and the first magnet 35, the firing end 131 remains in contact or magnetically attract without contact with the first magnet 35 as it moves gradually away from the chamber 122, driving the boresight device 3 to move in the direction away from the chamber 122 alongside it. This operation creates the gap G to receive the boresight device 3 and reopens the window 110*a*. The shooter can then easily remove the boresight device 3 through the window 110*a*. Subsequent normal firing operations can be performed afterward.

Thereby, high-precision calibration of the firearm calibration system. 100 and extraction of the boresight device 3 are completed conveniently and quickly.

The above are only specific embodiments of the present disclosure, but the protection scope of the present disclosure is not limited thereto. Any person skilled in the art can easily conceive of changes or substitutions within the technical scope disclosed in the present disclosure, which shall be covered by the protection scope of the present disclosure. Therefore, the protection scope of the present disclosure shall be subject to the protection scope of the claims.

What is claimed is:

1. A boresight device configured for calibrating a firearm, insertable into a chamber of the firearm, the boresight device comprising:

a housing configured to be placed in the chamber of the firearm, the housing defining an emitting surface at a first end;

a light-emitting assembly received in the housing and configured to emit a light beam out of the firearm when the housing is placed in the firearm; and a magnet attached to the housing, wherein the magnet is positioned to magnetically engageable with a portion of the firearm, and the magnet is movable relative to the chamber; and wherein the magnet is positioned on a rear end of the housing and is configured to magnetically engage with the firing end of the firearm such that when the firing end moves away from the chamber, the boresight device moves together with the firing end thereby moving the boresight device out of the chamber.

2. The boresight device according to claim 1, wherein: the magnet is selected from a ferrite permanent magnet represented by a formula of $MO{\cdot}Fe_2O_3$, a neodymium-iron-boron (NdFeB) permanent magnet, an aluminum-nickel-cobalt (AlNiCo) permanent magnet, or an iron-chromium-cobalt (FeCrCo) permanent magnet;

wherein:

M of the formula is selected from Ba, Sr, Ca, Mg, Zn and Pb,

O of the formula is oxygen.

3. The boresight device according to claim 1, wherein:

the boresight device is further configured to be inserted in the chamber with the emitting surface facing a muzzle of the firearm, and the portion of the firearm aligns with the muzzle and the chamber, and the portion of the firearm is located away from the muzzle; and when the portion of the firearm moves away from the chamber, and the magnet magnetically attracts the portion of the firearm thereby pulling the boresight device away from the muzzle.

4. The boresight device according to claim 1, wherein:

the housing further comprises a second end opposite to the first end; and the magnet is received at the second end, and an end surface of the magnet is exposed outside the housing, the end surface of the magnet magnetically engages with the portion of the firearm.

5. The boresight device according to claim 4, wherein:

the second end defines a first recess;

the magnet is received in the first recess; and the end surface is further exposed from the first recess to magnetically engage with the firearm.

6. The boresight device according to claim 5, wherein:

the magnet is affixed in the first recess via an interference fit.

7. The boresight device according to claim 5, wherein:

the magnet is received in the first recess via an adhesive layer between the magnet and the housing.

8. The boresight device according to claim 1, wherein:

the magnet comprises an end surface opposite the portion of the firearm;

in a cross-sectional view, a straight line along which the light beam propagates extends past the end surface of the magnet.

9. The boresight device according to claim 1, wherein:

the housing comprises a first part and a second part detachably connected to the first part;

the first part has a receiving space;

the light-emitting assembly is received in the receiving space; and the magnet is received in the second part.

10. The boresight device according to claim 9, wherein:

the second part comprises a connection end and a tail end opposite to the connection end and away from the first part;

the connection end is configured to detachably connect the second part to the first part;

the tail end defines a first recess with an opening facing the portion of the firearm; and the first recess is configured to receive the magnet.

11. The boresight device according to claim 10 further comprising:

a power source detachably received in the housing; and an other magnet;

wherein the second part defines a second recess at a side adjacent to the first part, the second recess communicates with the receiving space of the first part, the other magnet is received in the second recess; and the power source magnetically engages with the other magnet.

12. A firearm calibration system comprising:

a firearm comprising:

a main body;

a barrel installed inside the main body, the barrel having a chamber configured for receiving a cartridge and a muzzle;

a sighting device mounted on the main body; and a firing end located beside the chamber, configured for firing the cartridge, and movable relative to the chamber; and a boresight device comprising:

a housing inserted into an end of the chamber which is beside the firing end;

a laser received in the housing for emitting a light beam externally from the firearm via the muzzle of the barrel; and a magnet attached to a rear end of the housing and attracted by the firing end; and when the firing end moves away from the chamber, the boresight device moves together with the firing end thereby moving the boresight device out of the chamber.

13. The firearm calibration system according to claim 12, wherein: the magnet is is selected from a ferrite permanent magnet represented by a formula of $MO{\cdot}Fe_2O_3$, a neodymium-iron-boron (NdFeB) permanent magnet, an aluminum-nickel-cobalt (AlNiCo) permanent magnet, or an iron-chromium-cobalt (FeCrCo) permanent magnet;

wherein:

M of the formula is selected from Ba, Sr, Ca, Mg, Zn and Pb,

O of the formula is oxygen.

14. The firearm calibration system according to claim 12, wherein:

a maximum outer diameter of the housing matches an inner diameter of the chamber; and the housing comprises a first end for emitting the light beam and a second end opposite to the first end, the second end having an outer diameter less than the inner diameter of the chamber; and the magnet is received in the second end.

15. The firearm calibration system according to claim 14, wherein:

the firearm further comprises an ejection hook for hooking and pulling a casing of the cartridge out of the chamber, the ejection hook located at an outside of the second end so as to not interfere with the boresight device.

16. The firearm calibration system according to claim 12, wherein: the magnet comprises an end surface opposite the portion of the firearm; and in a cross-sectional view, the end surface of the magnet fully covers the portion of the firearm to magnetically engage with the magnet.

17. A method for calibrating a firearm, the method comprising:

providing a firearm comprising:

a main body;

a barrel installed inside the main body, the barrel having a chamber for receiving a cartridge and a muzzle;

a sighting device mounted on the main body; and a firing end located beside the chamber for firing the cartridge and movable relative to the chamber; and inserting a boresight device into the chamber comprising:

a housing configured to be inserted in an end of the chamber which is beside the firing end;

a laser received in the housing for emitting a light beam externally from the firearm via the muzzle of the barrel; and a magnet attached to the housing and attracted by the firing end; and activating the boresight device to emit the light beam through the muzzle so as to form a light spot on a target located at a predetermined distance;

adjusting the sighting device to align an aiming point of the sighting device with the light spot;

moving the firing end towards a direction away from the chamber and driving the boresight device to move out of the chamber by magnetically engaging with the firing end.

18. The method according to claim 17, further comprising:

operating the firearm to open an ejection port of the main body to eject the cartridge out of the firearm through the ejection port; and removing the boresight device from the firearm when the ejection port opens.

* * * * *